US006076190A

United States Patent [19]

Besson

[11] Patent Number: 6,076,190

[45] Date of Patent: Jun. 20, 2000

[54] PROTECTIVE GLOVE OF COAT OF MAIL MATERIAL

[75] Inventor: Bernard R. Besson, Paris, France

[73] Assignee: Etablissements Foin, Paris, France

[21] Appl. No.: 09/257,484

[22] Filed: Feb. 25, 1999

[30] Foreign Application Priority Data

Feb. 26, 1998 [FR] France ..... 98 02325

[51] Int. Cl.[7] ..... A41D 19/00

[52] U.S. Cl. ..... 2/161.6; 2/16; 2/59; 2/162; 2/170

[58] Field of Search ..... 2/16, 59, 159, 2/161.6, 167, 162, 170, 141.2, 158

[56] References Cited

U.S. PATENT DOCUMENTS

| | | | |
|---|---|---|---|
| 3,835,472 | 9/1974 | Duggins | 2/161 A |
| 4,388,733 | 6/1983 | Anstett | 2/161 |
| 4,471,495 | 9/1984 | Kruse et al. | 2/162 |
| 4,493,865 | 1/1985 | Kuhlmann et al. | 428/52 |
| 4,750,218 | 6/1988 | Ziegler | 2/159 |
| 4,841,577 | 6/1989 | Lars-Jos | 2/161 |
| 5,054,126 | 10/1991 | Rivkin | 2/161 |
| 5,088,123 | 2/1992 | MacDonald | 2/162 |
| 5,511,241 | 4/1996 | Ziegler | 2/2.5 |
| 5,704,066 | 1/1998 | Yamamoto | 2/161.6 |
| 5,729,831 | 3/1998 | Kuhlmann | 2/16 |
| 5,862,521 | 1/1999 | Van Marwijk et al. | 2/16 |
| 5,894,602 | 4/1999 | Smith et al. | 2/159 |

FOREIGN PATENT DOCUMENTS

| | | |
|---|---|---|
| 2.029.073 | 10/1970 | France . |
| 2 275 174 | 8/1994 | United Kingdom . |
| WO 96/11595 | 4/1996 | WIPO . |

*Primary Examiner*—John J. Calvert
*Assistant Examiner*—Katherine Moran
*Attorney, Agent, or Firm*—Seidel, Gonda, Lavorgna & Monaco, PC

[57] ABSTRACT

Protective glove of coat of mail material characterised in that the band for holding the glove (1) in position is constituted by a strip (6) which is rolled up on itself in such a manner as to constitute a spiral spring which is movable between, on the one hand, an open position and, on the other hand, a retracted position towards which it is returned if no external force is exerted on it, the spiral spring (6) being able to slide in the annular pocket (3) in order to move towards the open position under the action of the force exerted by the user when he puts the glove (1) on, before being automatically returned to the retracted position in order to hold the glove around the user's wrist

6 Claims, 3 Drawing Sheets

PROTECTIVE GLOVE OF COAT OF MAIL MATERIAL

Figure 1:
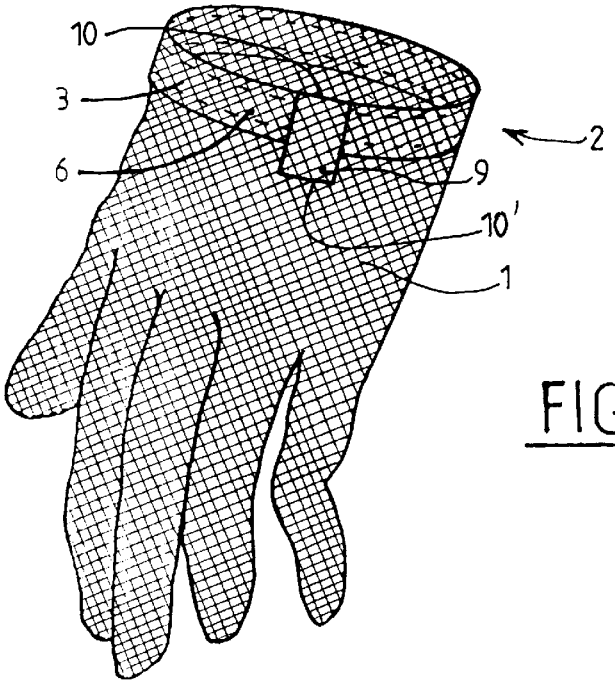

The present invention relates to a protective glove of coat of mail material which is to protect the hands of specific workers who are especially at risk, particularly in food industries, such as, for example, trades concerned with meat, food preparation, plastics materials, cardboard, etc.

In factories or workshops in which workers have to handle objects that cut and that are therefore dangerous, the workers are subject to the risk of serious cuts to the hands if appropriate precautions are not taken.

In order to overcome those disadvantages, it is becoming increasingly common for the Authorities to prescribe the use of protective gloves of coat of mail material; such a material, which is both supple and resistant to perforation, has the advantage of providing the desired safety and also, because it is relatively light, of not being too tiresome to use.

The first protective gloves of that type proposed on the market were equipped, in the region of the user's wrist, with a strap of nylon material welded to each side of the coat of mail material and provided with a buckle and loops enabling the strap to be adjusted and the glove to be held around the user's wrist.

Such gloves are not entirely satisfactory from the point of view of hygiene because, especially in the field of butchery, the nylon material becomes impregnated with blood and may promote the development of bacteria.

Consequently, it has been proposed that the strap of nylon material be replaced by a strap of synthetic material which is secured to the coat of mail material, for example, by heat-fusing, and which is equipped with devices for closing by means of press-studs. Such gloves fulfil their function satisfactorily and have been found to be more hygienic than their predecessors; however, they have the disadvantage of having a service life governed by that of the strap, which becomes worn faster than the coat of mail material, and all the more so if the gloves are used daily and have to be washed at high temperature: when the strap is damaged, the glove can no longer be used.

In order to improve that glove, a protective glove has been proposed, in particular in accordance with document FR-A-2 729 274, which comprises, at its end located in the region of the user's wrist, an annular pocket which forms a sheath and which is defined by the superposition of two thicknesses of coat of mail material and contains a band for holding the glove in position, which band is produced from synthetic material and is capable of being adjusted and closed by a press-stud system.

A glove of that type has the advantage of not having to be discarded as soon as the holding band becomes worn; its ergonomics are not, however, entirely satisfactory, given that the press-stud system is not the easiest to manipulate. In addition, press-stud closure systems, which are generally produced from nickel-chromium alloys, may give rise to allergies when they are in contact with the skin Furthermore, the material forming the holding band may have irregularities which constitute points where dirt may become caught.

It should also be noted that, in order to enable them to be put on, all gloves of coat of mail material that are equipped with a strap closure system must necessarily be slit laterally at right-angles to the user's wrist; in the region of the slit, the user's hand and wrist therefore remain exposed to any cuts by a knife or any type of cutting object.

It should also be noted that document WO-96/11595 has already proposed a protective glove of coat of mail material comprising a resilient closure element constituted by a helical spring. The presence of such a spring is, however, a source of disadvantages both with regard to manufacture and with regard to use; in addition, dirt may readily become caught between its turns and remain there after washing, which means that such a protective glove is not entirely satisfactory from the point of view of hygiene.

The aim of the present invention is to overcome those disadvantages by proposing a protective glove of coat of mail material that is totally satisfactory from the point of view of safety and hygiene, has increased strength and improved ergonomics and, at the same time, does not involve the risk of causing allergy problems.

To that end, the invention relates to a protective glove of the above-mentioned type, comprising, at its end located in the region of the user's wrist, an annular pocket which forms a sheath and which is defined by the superposition of two thicknesses of coat of mail material and contains a band for holding the glove in position.

According to the invention, the glove is characterised in that the band for holding the glove in position is constituted by a strip which is rolled up on itself in such a manner as to constitute a spiral spring which is movable between, on the one hand, an open position and, on the other hand, a retracted position towards which it is returned if no external force is exerted on it; consequently, the spiral spring can slide in the annular pocket in order to move towards the open position under the action of the force exerted by the user when he puts the glove on, before being automatically returned to the retracted position in order to hold the glove around the user's wrist.

Consequently, the glove adjusts itself automatically as soon as the user has put it on, without requiring the manipulation of any closure members According to the invention, it is of course necessary for the features of the spiral spring, which is generally produced from stainless steel, to be adapted to the dimensions of the glove and in particular for its outside diameter at rest in the retracted position to be smaller than that of the annular pocket in order to permit the "tightening" of the coat of mail material in that region and the maintenance of the glove around the user's wrist.

A significant feature of the glove forming the subject-matter of the invention is associated with the fact that the coat of mail material covers all of the user's hand without leaving a gap into which the tip of a knife could penetrate.

Another significant feature of the glove is associated with the fact that it can be produced entirely from stainless steel, which prevents it from being a source of allergies and enables it to be entirely hygienic and, in addition, to have a service life which is distinctly improved compared with the gloves of the prior art because the service life is not governed by the strength of a closure strap produced from plastics material, which is by its nature more fragile than a coat of mail material.

According to a further feature of the invention, the glove is extended, beyond the user's wrist and beyond the annular pocket containing the holding band, by a cuff which is likewise produced from coat of mail material and which enables the user's wrist and forearm to be protected; the protective cuff comprises, at its end remote from the user's wrist, an auxiliary annular pocket forming a sheath, which pocket is likewise defined by the superposition of two thicknesses of coat of mail material and contains an auxiliary holding band constituted by a strip which is rolled up on itself in such a manner as to constitute a spiral spring substantially similar to the strip positioned in the annular pocket arranged in the region of the user's wrist.

Consequently, in accordance with that feature, the glove is equipped with two similar spiral springs, generally produced from stainless steel, one being arranged in the region of the wrist and the other in the region of the forearm; both springs can move into an open position and can close into a retracted position by sliding in the associated annular pocket and they thus permit the forcible positioning of the glove and its automatic maintenance around the user's wrist and forearm.

That feature provides more complete protection in the region of the user's forearm.

It should of course be noted that the advantage of the absence of a slit in the coat of mail material is repeated in the region of the auxiliary annular pocket and the user's forearm.

The annular pocket and, where applicable, the auxiliary annular pocket can of course, without departing from the scope of the invention, be produced in any desired manner, especially by the addition of a supplementary coat of mail band and the securing thereof in the region of its longitudinal edges or by simply turning down on itself a band of coat of mail material.

According to a further feature of the invention, the cuff is equipped with one or more sheath-forming reinforcing pockets which is(are) likewise defined by the superposition of two thicknesses of coat of mail material and which extend(s) substantially perpendicularly to the annular pocket and to the auxiliary annular pocket over substantially the entire length of the cuff; the reinforcing pocket(s) contain(s), respectively, a stiffening strip, especially of steel, which prevents any folding of the cuff onto itself about the user's wrist, and which is consequently capable of improving the protection of the forearm.

According to a further feature of the invention, the protective glove is equipped, in the region of the user's wrist, with an external lateral band of coat of mail material which is secured by its ends to the coat of mail material constituting the glove in such a manner as to facilitate the opening of the holding band.

The presence of the external lateral band is found to be especially advantageous when the user wishes to remove his glove.

It should be noted that the glove according to the invention can be produced symmetrically so that it can fit a right hand or a left hand.

It should also be noted that the protective glove may be equipped with an identification disc secured in the region of the back of the user's hand.

Such a disc may carry various types of information, such as, for example, the size of the glove, the standard to which it corresponds or the identity of its owner. It may be formed by a disc produced in a colour which is selected as a function of the size of the glove, or by a stainless steel badge which is, in particular, secured to the coat of mail material by means of rings.

Figure 2:
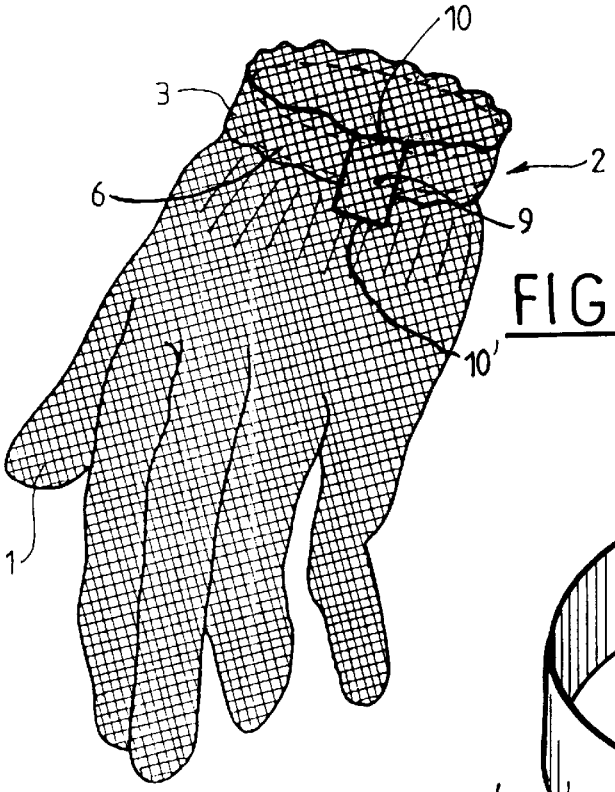
Figure 3:
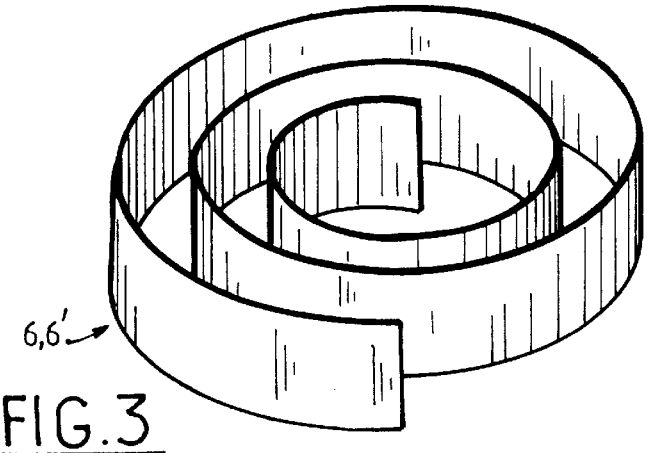
Figure 4:
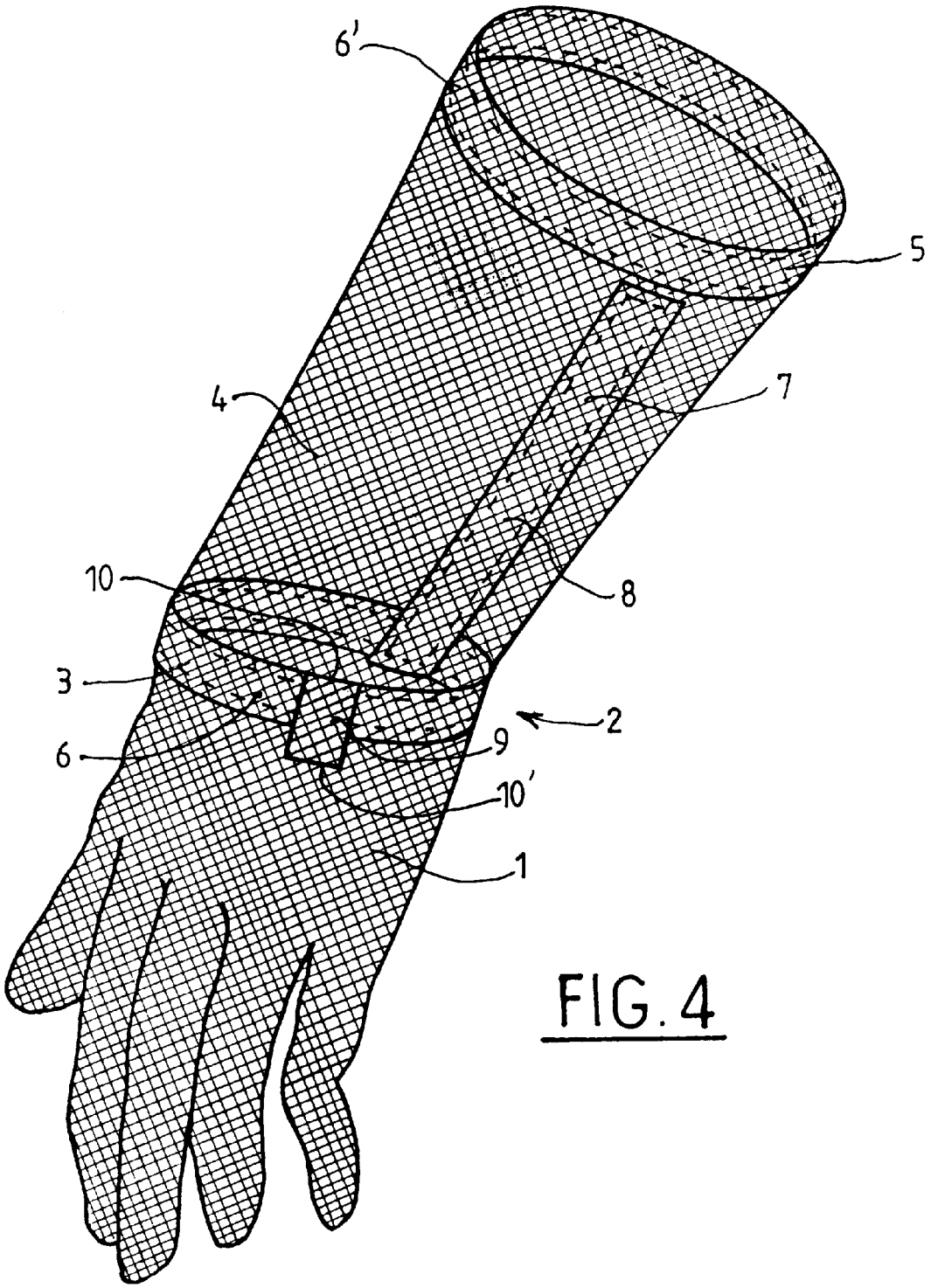
Figure 5:
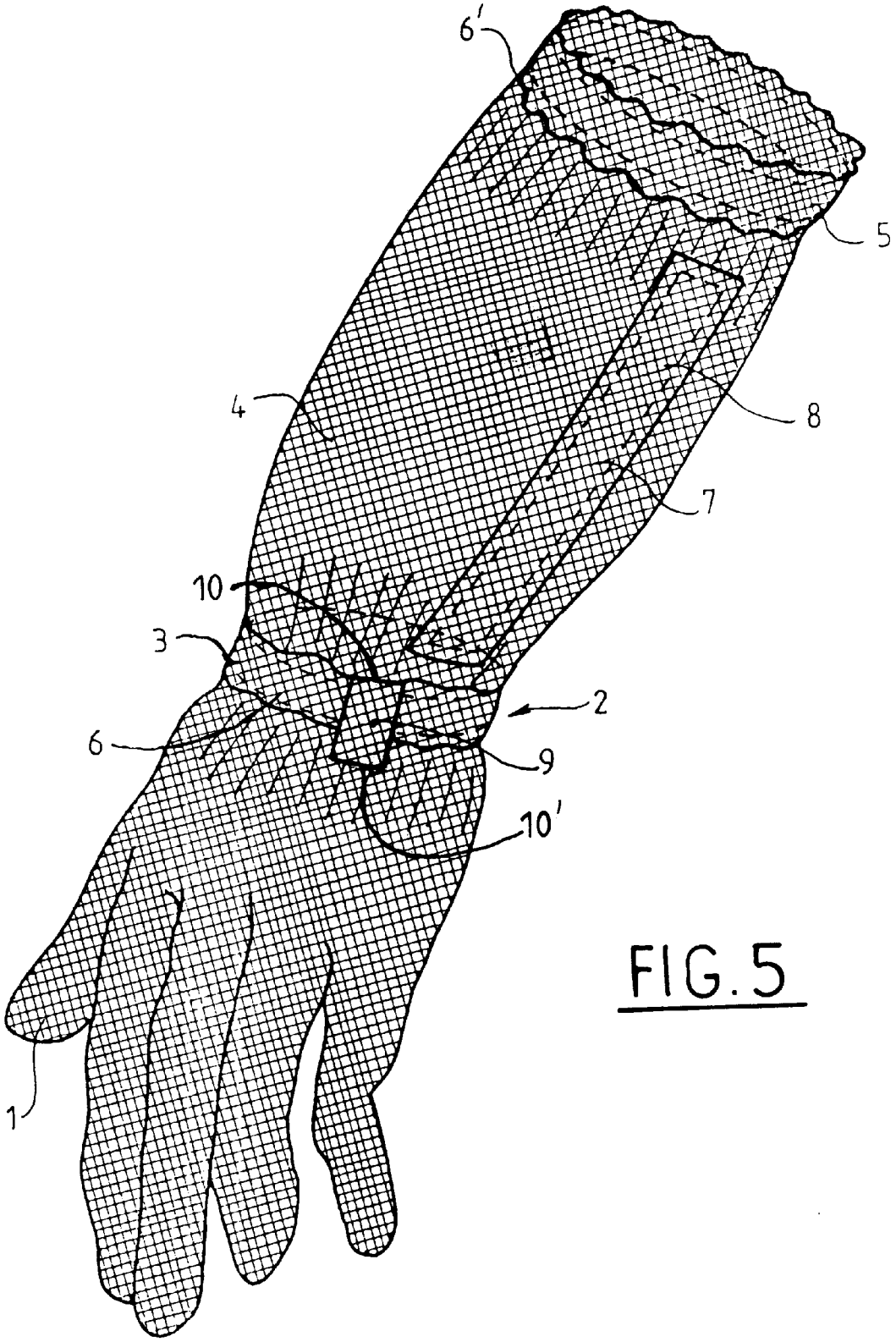

The features of the protective glove forming the subject-matter of the invention will be described in more detail with reference to the appended drawings in which:

FIG. 1 represents a protective glove according to the invention, in the open position, FIG. 2 represents the same glove in the retracted position, FIG. 3 represents a band for holding the glove in position, FIG. 4 represents a protective glove provided with a cuff in the open position, FIG. 5 represents the glove shown in FIG. 4 in the retracted position.

According to FIGS. 1 and 2, the protective glove 1 is produced from a coat of mail or chain mail material and comprises at its end 2, located in the region of the user's wrist, an annular pocket 3 which forms a sheath and which is defined by the superposition of two thicknesses of coat of mail material.

The annular pocket 3 contains a strip of steel 6 which is rolled up on itself in such a manner as to define a band for holding the glove in position, which band is shown diagrammatically by a broken line in FIGS. 1 and 2.

It should be noted that, in a manner which does not limit the invention, the steel strip 6 generally has a width of from 15 to 25 mm and a thickness of the order of from 0.20 to 0.30 mm.

According to FIG. 3, the steel strip 6 constitutes a spiral spring which is at rest in a retracted position; according to FIG. 2, in that position, the spiral spring 6 tightens the coat of mail material in the region of the annular pocket 3 in order to hold the protective glove on the user's wrist.

According to FIG. 1, when putting the protective glove on, the user exerts at the internal portion of the spring 6 a force causing it to move towards an open position by sliding in the annular pocket 3. When the glove is in place, the spring 6 is automatically returned towards the retracted position shown in FIG. 2; the adjustment of the glove around the user's wrist is therefore automatic According to FIGS. 1 and 2, an external lateral band 9 of coat of mail material is secured by its ends 10, 10' to the coat of mail material constituting the glove 1. The band is to be gripped by the user in order to enable him to remove his glove more readily.

According to FIGS. 4 and 5, the glove 1 is extended beyond the user's wrist and beyond the annular pocket 3 by a cuff 4 which is likewise produced from coat of mail material and which comprises at its end remote from the annular pocket 3 an auxiliary annular pocket 5 which forms a sheath and which is likewise defined by the superposition of two thicknesses of coat of mail material.

Like the annular pocket 3, the auxiliary annular pocket 5 contains a steel strip 6' which is rolled up on itself in such a manner as to define an auxiliary band for holding the glove in position, which band is represented diagrammatically by broken lines in FIGS. 4 and 5.

The steel strip 6' is broadly similar to the steel strip 6 and likewise constitutes a spiral spring which is at rest in a retracted position in which, as shown in FIG. 5, it tightens the coat of mail material in the region of the auxiliary annular pocket 5 in order to hold the protective glove on the user's forearm.

According to FIG. 4, when putting the protective glove on, the user exerts, not only at the internal portion of the spring 6 but also at the internal portion of the spring 6', a force causing it to be moved forcibly towards an open position by sliding in the auxiliary annular pocket 5. When the glove is in place, the spring 6' is automatically returned towards the retracted position represented in FIG. 5; the adjustment of the glove around the user's forearm, like its adjustment around the wrist, is therefore automatic.

Furthermore, and according to FIGS. 4 and 5, the cuff 4 is equipped with a sheath-forming reinforcing pocket which is likewise defined by the superposition of two thicknesses of coat of mail material and which extends substantially perpendicularly to the annular pocket 3 and to the auxiliary annular pocket 5 over substantially the entire length of the cuff 4.

Although only one of those pockets has been represented in FIGS. 4 and 5, the protective glove could of course comprise several such pockets distributed over the periphery of the cuff 4 without departing from the scope of the invention.

The pocket 7 contains a steel stiffening strip 8 shown diagrammatically in FIGS. 4 and 5.

The stiffening strip prevents the cuff from being folded onto itself around the user's wrist.

According to FIGS. 4 and 5, the cuffed glove is also equipped with an external lateral band 9 similar to that shown in FIGS. 1 and 2.

What is claimed is:

1. A protective glove of chain mail material for protecting the hands of workers, especially in trades concerned with meat, comprising:

a glove made from chain mail material;

a first annular pocket located in the region of a user's wrist when worn and connected to the glove the annular pocket forming a sheath, the sheath defined by the superposition of two thicknesses of chain mail material; and a holding band contained in the first annular pocket, the band being constituted by a strip which is rolled up on itself in such a manner as to constitute a spiral spring which is movable between an open position and a retracted position towards which it is returned if no external force is exerted on it, the spiral spring being able to slide in the annular pocket in order to move towards the open position under the action of the force exerted by the user when donning the glove, before being automatically returned to the retracted position in order to hold the glove around the user's wrist.

2. A protective glove according to claim 1 further comprising a cuff: the cuff connected to the first annular pocket, the cuff having an end remote from the connection to the first annular pocket and extending beyond the user's wrist, the cuff being of chain mail material, the cuff comprising at its end remote from the first annular pocket a second annular pocket, the second annular pocket defined by the superposition of two thicknesses of chain mail material and containing a second holding band constituted by a strip which is rolled up on itself in such a manner as to constitute a spiral spring movable between an open position and a retracted position towards which it is returned if no external force is exerted on it, the second spiral spring being able to slide in the second annular pocket in order to move towards the open position under the action of the force exerted by the user when donning the glove.

3. A protective glove according to claim 2, wherein the cuff further comprises at least one reinforcing pocket defined by the superposition of two thicknesses of chain mail material, the reinforcing pocket extending substantially perpendicular to the first annular pocket and to the second annular pocket over substantially the entire length of the cuff, the reinforcing pocket containing a stiffening strip which prevents any folding of the cuff onto itself about the user's wrist.

4. A protective glove according to claim 1 wherein the holding band is made of steel.

5. A protective glove according to claim 1, further comprising an external lateral band of chain mail material in the region of the user's wrist, the lateral band of chain mail material secured by its ends to the glove in such a manner as to facilitate the opening of the holding band.

6. A protective glove according to claim 1 wherein the protective glove is symmetrical so that it can fit a right hand or a left hand.

* * * * *